US009327944B2

(12) United States Patent
Strahle et al.

(10) Patent No.: US 9,327,944 B2
(45) Date of Patent: May 3, 2016

(54) APPARATUS FOR ASSEMBLING OR DISMANTLING A CRANE

(71) Applicant: Liebherr-Werk Biberach GmbH, Biberach an der Riβ (DE)

(72) Inventors: Alexander Strahle, Langenau (DE); Thomas Herse, Biberach (DE)

(73) Assignee: Liebherr-Werk Biberach GmbH, Bieberach an der Riss (DE)

( * ) Notice: Subject to any disclaimer, the term of this patent is extended or adjusted under 35 U.S.C. 154(b) by 0 days.

(21) Appl. No.: 14/361,595

(22) PCT Filed: Nov. 22, 2012

(86) PCT No.: PCT/EP2012/004835
§ 371 (c)(1),
(2) Date: May 29, 2014

(87) PCT Pub. No.: WO2013/079175
PCT Pub. Date: Jun. 6, 2013

(65) Prior Publication Data

US 2014/0333079 A1 Nov. 13, 2014

(30) Foreign Application Priority Data

Nov. 30, 2011 (DE) ..... 10 2011 119 898

(51) Int. Cl.

| | |
|---|---|
| ***B66C 1/34*** | (2006.01) |
| ***B66C 1/36*** | (2006.01) |
| ***B66C 23/28*** | (2006.01) |
| ***E04H 12/34*** | (2006.01) |
| ***B66C 13/08*** | (2006.01) |

(52) U.S. Cl.
CPC . *B66C 1/36* (2013.01); *B66C 13/08* (2013.01); *B66C 23/286* (2013.01); *E04H 12/342* (2013.01)

(58) Field of Classification Search
CPC ..... B66C 1/36; B66C 1/10; B66C 1/34; B66C 1/38; B66C 1/24; B66C 1/105; B66C 1/62; B66C 1/101; B66C 1/22; B66C 1/14; B66C 1/12; B66C 23/286; B66C 23/283; B66C 1/125; E04H 12/342
USPC ..... 294/82.31, 82.33, 67.21, 67.5, 81.3, 75, 294/81.56; 212/195
See application file for complete search history.

(56) References Cited

U.S. PATENT DOCUMENTS

| | | | | | |
|---|---|---|---|---|---|
| 2,327,751 | A | * | 8/1943 | Unthank et al. | 294/82.32 |
| 2,736,599 | A | * | 2/1956 | Coffing | 294/82.31 |
| 3,109,676 | A | * | 11/1963 | Mercer | 294/82.31 |
| 3,173,718 | A | * | 3/1965 | Harley | 294/82.25 |
| 3,311,401 | A | * | 3/1967 | Bacon | 294/82.3 |
| 3,895,836 | A | | 7/1975 | Barnes | |

(Continued)

FOREIGN PATENT DOCUMENTS

| | | |
|---|---|---|
| DE | 1184050 B | 12/1964 |
| DE | 2629079 A1 | 2/1977 |

(Continued)

*Primary Examiner* — Gabriela Puig
(74) *Attorney, Agent, or Firm* — Dilworth & Barrese, LLP

(57) ABSTRACT

An apparatus (1) for assembling or dismantling a crane has a coupling unit (11) for coupling with a tower part (3). The coupling unit (11) can be moved into a latching position or into an unlatching position. The coupling unit (11) furthermore has counterweights (110) for setting a center of gravity of the crane.

8 Claims, 10 Drawing Sheets

(56) References Cited

U.S. PATENT DOCUMENTS

| | | | | |
|---|---|---|---|---|
| 3,964,777 | A | 6/1976 | Lindqvist | |
| 4,530,535 | A * | 7/1985 | Hargreaves | 294/82.33 |
| 5,865,491 | A * | 2/1999 | Lee | 294/67.5 |
| 2002/0001517 | A1 | 1/2002 | Aarre | |
| 2006/0087137 | A1 * | 4/2006 | Mongan | 294/82.35 |
| 2010/0308000 | A1 * | 12/2010 | York | 212/270 |

FOREIGN PATENT DOCUMENTS

| | | | | |
|---|---|---|---|---|
| DE | 4221915 | A1 | 1/1994 | |
| GB | 861037 | A | 2/1961 | |
| GB | 910904 | A * | 11/1962 | B63B 23/58 |
| GB | 1098232 | A | 1/1968 | |

* cited by examiner

APPARATUS FOR ASSEMBLING OR DISMANTLING A CRANE

BACKGROUND OF THE INVENTION

The invention relates to an apparatus for assembling or dismantling a crane.

A plurality of cranes, in particular of tower slewing cranes, are known from the prior art. It is also known that a traverse is attached to tower parts to be climbed for climbing tower slewing cranes. The hanging of the traverse into the assembly hook of a tower part located at the ground takes place by an installer who climbs into the tower part to be climbed and guides the assembly hook such that the tower part to be climbed is securely received in the assembly hook.

The traverse received by the assembly hook is passed on into an installation position at an installation crane trolley which is attached to an installation tower. The passing of the tower part to be climbed to the installation crane trolley takes place by placing the traverse down into the installation crane trolley. Since no securing unit is provided in the known assembly hooks, there is the risk that the traverse with the tower part to be climbed is pressed out of the assembly hook on an unintentional placing down or canting and the tower part falls down.

The crane, in particular the tower slewing crane, must be balanced by a counterweight at a lifting hook for the climbing process so that the center of gravity of the tower slewing crane lies in a longitudinal axis of the tower slewing crane. This is necessary to avoid a tilting of the crane and, in the worst case, a toppling over on the climbing process. As a rule, a further tower part is fastened to the lifting hook with a lifting chain or a slip for this purpose. The lifting hook has to be traveled downward again for the fastening and an installer hangs the counterweight into the lifting hook. For climbing, the counterweight is raised to the level of the guide piece and is traveled into the balance position. After the climbing procedure, the counterweight is let down and unhung. A hook block having the assembly hook is traveled upward again.

SUMMARY OF THE INVENTION

It is therefore the object of the present invention to provide an apparatus for assembling and/or dismantling a crane which at least does not have the previously named disadvantages.

This object is solved by the subject-matter herein. Advantageous embodiments of the invention are also the subject-matter herein.

In accordance with the invention, an apparatus for assembling or dismantling a crane, in particular a tower slewing crane, has a coupling unit for coupling the apparatus to a carrier of a tower part. The coupling unit is configured and arranged such that it can be moved into a latching position for avoiding a release of a coupling of the coupling unit with the carrier of the tower part or into an unlatching position for coupling or decoupling the coupling unit with or from the carrier of the tower part.

The provision of a coupling unit having a latching position provides the advantage that a release of the coupling of the carrier of the tower part with the coupling unit by an unintentional placing down or canting of the carrier can be reliably and simply prevented. A release of the carrier from the coupling unit can only take place when the coupling unit is located in an unlatching position. The risk of a collapse of a tower part, for example on an incorrect placing onto the installation crane trolley is consequently avoided.

Any component or components are, for example, understood in the sense of the invention as a coupling unit which is located in a latching position which ensures or ensure that the carrier of the tower part cannot release itself from the coupling with the coupling unit on its own. A release or a decoupling should accordingly only be possible when the coupling unit is moved into an unlatching position. An unlatching position is understood as any state of the coupling unit in which at least a part of the carrier and thus the tower part are received for coupling with the coupling unit or is/are released for decoupling with the coupling unit.

In a preferred embodiment, the coupling unit can be a guide section, in particular a rotationally fixed guide section, for guiding at least a part of the carrier, in particular a cross pin of the carrier, of the tower part during a coupling process. The guide section can have a run-in slope. In addition, the coupling unit can have a rotatable hook. The hook and the guide section can be connected to a fastening section or the hook can be supported at the fastening section.

It can be ensured by the provision of the guide section, in particular of the guide section having the run-in slope, that the coupling unit, in particular the guide section, contacts at least a part of the carrier. Consequently, an installer is no longer required who guides the coupling unit on the ground accordingly.

Due to the provision of the guide section, in particular having a run-in slope, at least a part of the carrier will come into contact with the guide section and the hook on a lowering of the coupling unit. On a further lowering of the coupling unit and/or due to the hook's own weight and/or to the inherent weight of further counterweights provided at the coupling unit, at least a part of the carrier, in particular a cross-pin, is pressed against the hook. As a consequence of the force exerted onto the carrier by the cross-pin, the hook rotates such that the coupling unit is located in an unlatching position.

The carrier, in particular the cross-pin of the carrier, can penetrate into a reception space of the coupling unit. After a penetration of at least a part of the carrier, the hook again rotates into the latching position, with the coupling unit being coupled with the carrier. The coupling of the carrier with the coupling unit can be further simplified if a corresponding guide for the carrier, in particular the cross-pin, is provided at the hook. It must be stated as a result that the coupling of the carrier and thus of the tower part with the coupling unit automatically takes place by a lowering of the coupling unit. An installer is thus no longer necessary for the coupling of the coupling unit with the tower part located on the ground. The crane operator can simply lower the coupling unit in the direction toward the carrier.

The hook can be coupled with a clamping unit such as a spring device, in particular a gas pressure spring. In the event that the carrier and thus the tower part are moved, in particular into an installation position, the clamping unit can exert such a force on the hook that the hook is held in the latching position. Consequently, a release of the coupling of the coupling unit with the carrier of the tower part is effectively prevented by the provision of the clamping unit.

The hook can be configured such that a torque acts on the hook due to the inherent weight of the hook and/or to the weight of the carrier coupled to the hook and thus of the tower part. This torque is directed such that it holds the hook in the latching position. A secure transportation of the carrier and of the tower parts, for example into the installation position, can thereby be achieved in a simple manner.

In a preferred embodiment, the coupling unit can have a transmission means. The transmission means can be configured in boomerang shape and can be rotatably arranged at the fastening section of the coupling unit. In this respect, the axes of rotation of the hook and of the transmission means can be coincident. Furthermore, the transmission means can be coupled to the clamping unit, in particular to a gas compression spring, in particular directly. In addition, the transmission means can be coupled to the hook. The coupling of the transmission means to the hook can take place by a coupling means, such as a spigot, arranged on the hook.

In this respect, a pivotal connection point of the clamping unit with the transmission means can be provided such that on a movement of the tower part into the installation position, the clamping unit exerts such a force onto the transmission means that a first limb is directly in contact with the coupling means of the hook. As a consequence of the coupling of the first limbs with the coupling means of the hook, a torque acts thereon which holds the hook, and thus the coupling unit, in a latching position. Consequently, a simple design of the coupling unit can be provided to hold the hook in a latching position.

The transmission means can have a connection means at one end, in particular at an end of a second limb, which is couplable to an actuating bar. The transmission means can be rotated by a coupling of the actuation bar with the connection means, for example by a user. The actuation with the actuation bar can take place when the tower part is located in the installation position and serves the moving of the coupling unit into the unlatching position. The rotation of the transmission means in this respect takes place such that the second limb is rotated in the direction toward the coupling means of the hook. On an abutment of the second limb against the coupling means and on a further rotation of the transmission means in the same direction, the hook is rotated into an unlatching position. The hook is not rotated before an abutment of the second limb against the coupling means.

On an actuation of the transmission means by means of the actuation bar, the hook can be rotated so far that it is held in the unlatching position. This is because the transmission means and thus the pivotal connection point between the transmission means and the clamping unit, in particular the spring device, are rotated so far that a torque acts on the transmission means and thus on the hook which holds the hook and thus the coupling unit in the unlatching position. In the previously described coupling of the at least one part of the carrier with the coupling unit due to the lowering of the coupling unit and/or the inherent weight of the coupling unit, the pivotable connection point between the transmission means and the clamping unit, in contrast, only rotates so far that a torque is effected by the clamping unit on the transmission means and thus the hook which presses the hook into the latching position.

In this respect, an actuation of the transmission means can only take place when no load acts on the hook. This may be the case when the carrier is placed onto the installation crane trolley without error, for example. It can thus be determined in a simple manner by the actuation of the transmission means whether the carrier is placed on without error.

In accordance with another aspect of the invention, an apparatus for assembling or dismantling a crane, in particular a tower slewing crane, has a coupling unit for coupling the apparatus with a tower part. The apparatus can have all the previously named features. The coupling unit has at least one counterweight for setting a center of gravity of the crane. The counterweight can be movable into a balance position, in particular on climbing the crane. This can take place, for example, by a horizontal and/or vertical movement of the counterweight.

The advantage in the provision of a counterweight in the coupling unit is that it is no longer necessary, as in the prior art, to lower the coupling unit for coupling with the counterweight to take up the counterweight located on the ground. The counterweight can rather be immediately moved into a balance position without lowering the coupling unit. The balance takes place by the integrated counterweight at the hook. This results in a substantial time saving.

The hook can be coupled to the counterweight. The fastening section can in particular be connected to the counterweight.

The apparatus in accordance with the invention can be used for assembling or dismantling a tower slewing crane. Further cranes can naturally also be assembled or dismantled using the apparatus in accordance with the invention.

BRIEF DESCRIPTION OF THE DRAWINGS

Further details and advantages of the invention will now be explained in more detail with reference to an embodiment shown in the drawing.

There are shown.

DESCRIPTION OF THE PREFERRED EMBODIMENTS

Figure 1:
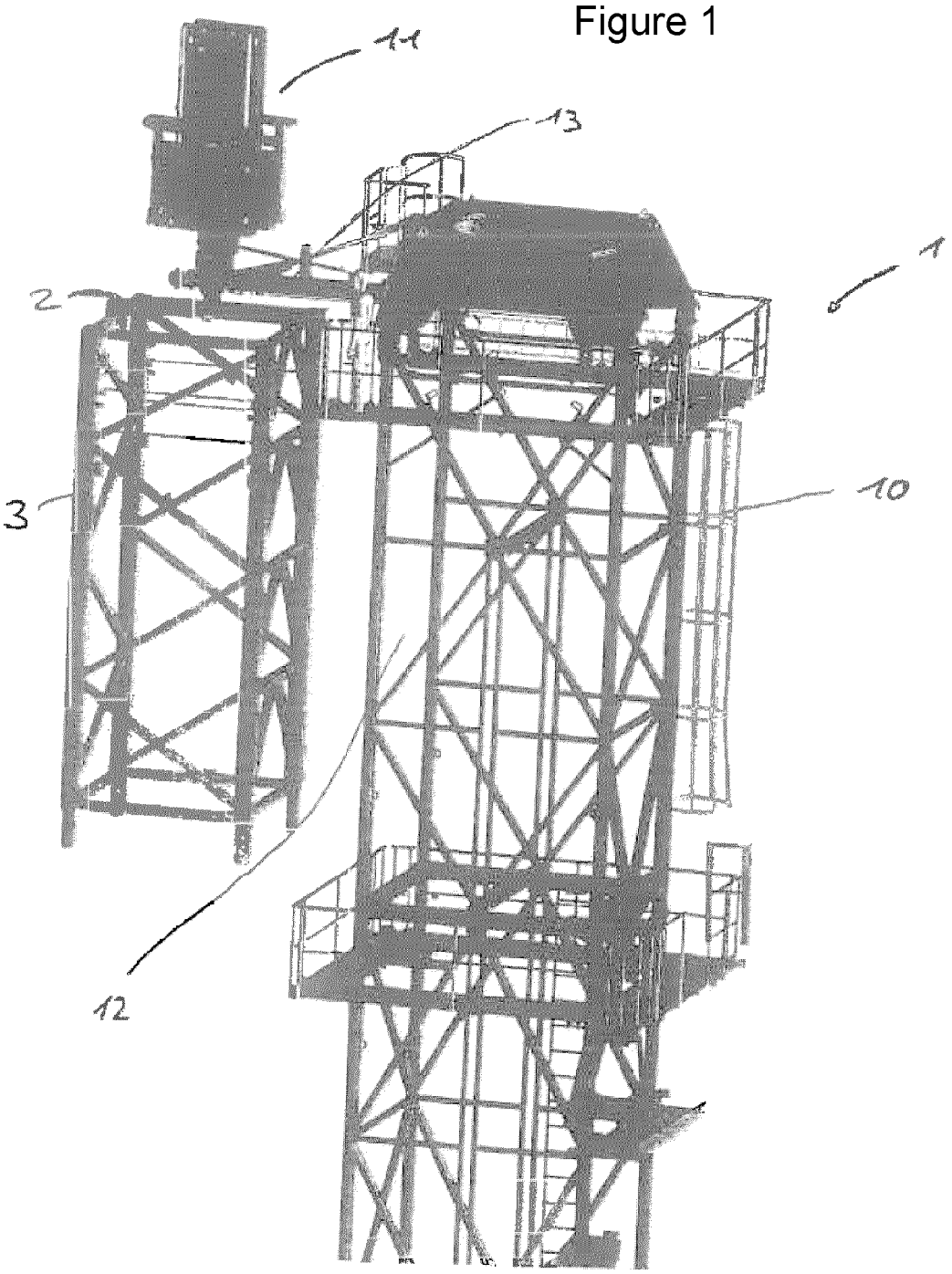
FIG. 1: a perspective representation of the apparatus for assembling and dismantling a crane.

The apparatus shown in FIG. 1 for assembling and dismantling a crane not shown in the Figures, in particular a tower slewing crane. The apparatus has an assembly tower 10 and a coupling unit 11 connected to the assembly tower 10. The coupling unit 11 is coupled with the carrier 2, with the carrier 2 carrying a tower part 3 to be climbed. For the assembly, the tower part 3 can be introduced into the assembly tower 10 via an opening 12 provided therein and can be connected to a tower not shown in the Figures. The introduction of the tower part into the opening can take place by an installation crane trolley 13, but is not restricted thereto. A dismantling of the tower can takes place in a reverse order to the assembly so that the following statements only relate to the assembly of the tower.

Figure 2:
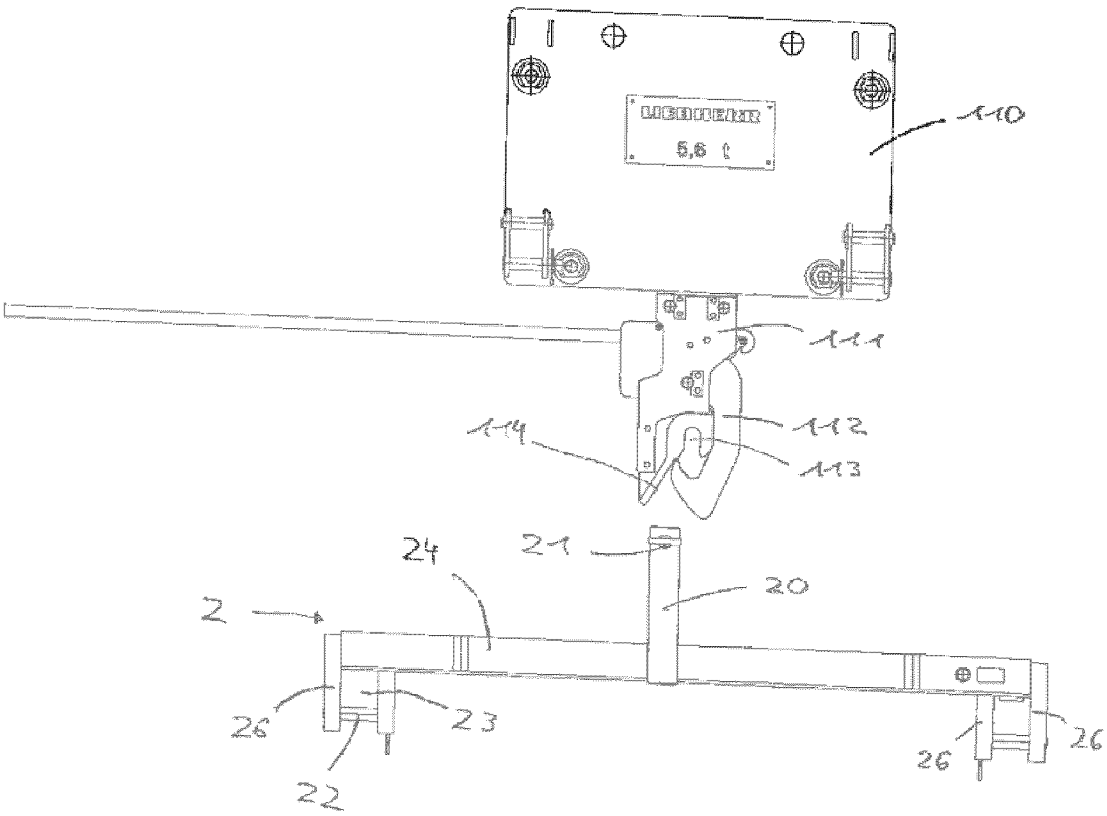
FIG. 2: a schematic representation of a part of a coupling unit and of a carrier for carrying a tower part.

As can be seen from FIG. 2, the carrier 2 has a longitudinal frame 24 at whose end respective first projections 26 extend. The projections 26 define a reception space 23 into which a part of the tower part 3 not shown in FIG. 2 penetrates. The reception space 23 is bounded by a pin 22. Furthermore, the carrier 2 has a second projection 20 which extends from the longitudinal frame 24 in the opposite direction to the projections 26. A cross-pin 21 is provided in an end of the projection 20 remote from the longitudinal frame 21.

Furthermore, a part of the coupling unit 11 is shown in FIG. 2. The coupling unit 11 thus has a counterweight 110. Furthermore, the coupling unit 11 has a pivotable hook 112 and a guide section 114 having a run-in slope. The guide section 114 has a reception groove 113 at an end of the run-in slope. The guide section 114 and the hook 112 are fastened to the fastening section 111. In this respect, the hook 112 is rotatably connected to the fastening section 111 and the guide section 114 is rotationally fixedly connected to the fastening section 111. The fastening section 111 can in turn be connected to the counterweight 110.

Figure 3B:
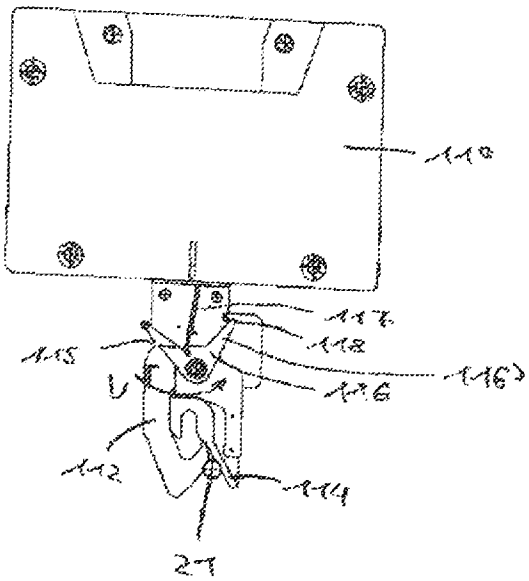
FIG. 3B: a sectional view along the line A-A of FIG. 3A.
Figure 3A:
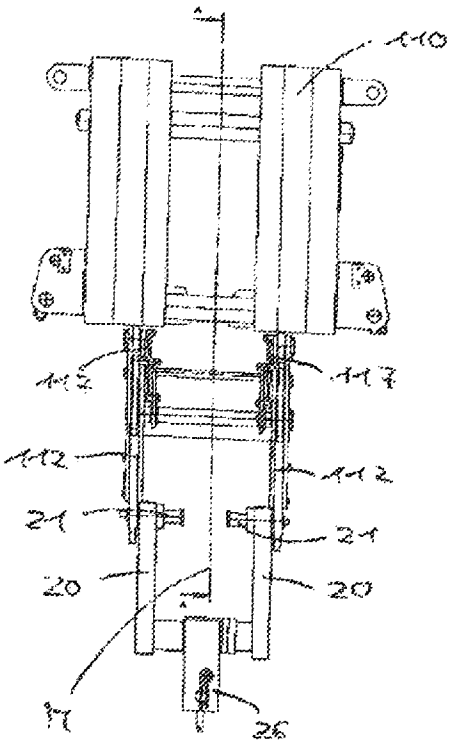
FIG. 3A: a rear view of a part of the coupling unit and of the carrier, with the coupling unit being located in a latching position.

As can be seen from FIG. 3A, the coupling unit 11 has a respective hook at two oppositely disposed sides with respect to a center axis M of the coupling unit 11. A plurality of counterweights 110 can be arranged at each side of the coupling unit 11. The cross-pins 21 project into a space which is formed between the projections 20 of the carrier 2. In this respect, the carrier 2 is directly coupled to the installation crane trolley 13 via the inwardly projecting part of the cross-pins 21 on a placing of the carrier 2 onto said installation crane trolley.

The state is shown in FIG. 3B in which the cross-pin 21 of the carrier 2 is in contact with the run-in slope of the guide section 114 and with the hook 112. This state of the coupling unit is adopted on a lowering of the coupling unit 11 to couple it with a tower part 3 or carrier 2 located on the ground. The coupling unit 11 is in this respect still in the latching position. In this respect, a spring device 117, in particular a gas pressure spring, is provided which holds the hook 112 in the latching position.

In this respect, the coupling unit 11 has a transmission means 116 which is rotatably arranged at the fastening section 111 and which is coupled, in particular directly, to the spring device 117 at a pivotal connection point. The transmission means 116 is furthermore coupled, in particular directly, via a first limb 116' to a first coupling means 118, such as a spigot, of the hook 112. In this respect, the spring device 117 acts on the transmission means such that the hook 112 is held in the latching position. More precisely, the force of the spring device introduced via the pivotal connection point 115 effects a torque and thus a rotation of the transmission means in the direction U. The rotation is directed such that the hook 112 is held in the latching position by the first limb 116' of the transmission means and by the coupling means 118.

Figure 4B:
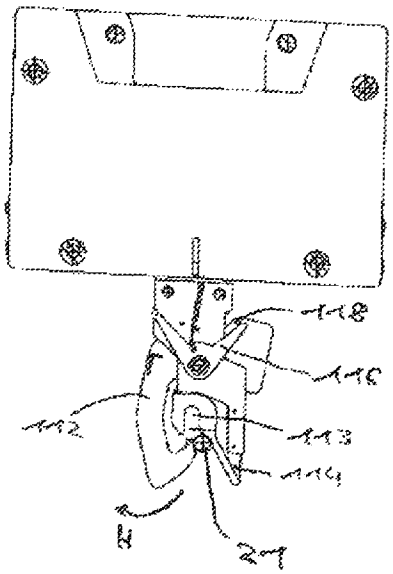
FIG. 4B: a sectional view along the line A-A of FIG. 4A.
Figure 4A:
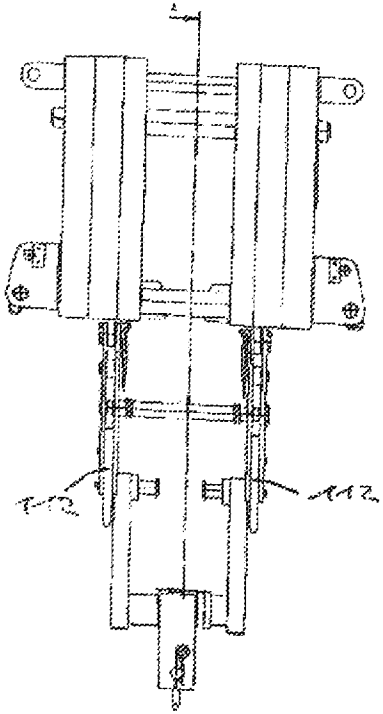
FIG. 4A: a rear view of a part of the coupling unit and of the carrier, with the coupling unit being located in an unlatching position.

When the coupling unit 11, in particular the hook 112, is placed onto the cross-pin 21, the hook 112 is rotated, in particular pressed on, as a consequence of the inherent weight of the counterweights 110, as can be seen from FIG. 4B. In this respect, FIG. 4B shows the hook 112 and thus the coupling unit in an unlatching position. The state shown in FIG. 4B is thus formed when the coupling unit is lowered further, starting from the state shown in FIG. 3B, so that the weight of the counterweights is no longer received by the apparatus, in particular by ropes of the apparatus. The hook 112 rotates in the direction H and the rotational movement of the hook 112 is transmitted via the coupling point 118 to the transmission means 116, whereby the latter is likewise rotated in the same direction. As a result, the cross-pin 21 penetrates into a space between the hook 112 and the run-in slope of the guide section 114. The penetration is in this respect facilitated by a guide provided at the hook 112 and by the run-in slope of the guide section 114.

Figure 5B:
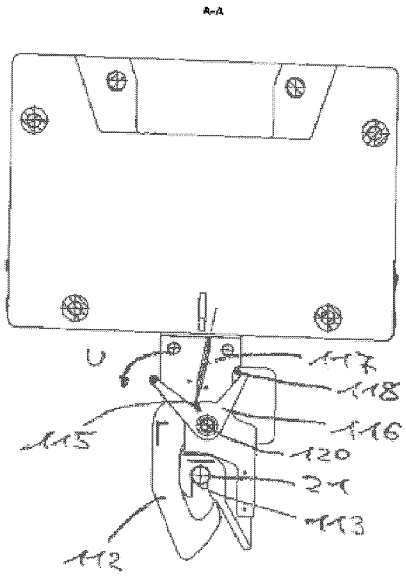
FIG. 5B: a sectional view along the line A-A of FIG. 5A.
Figure 5A:
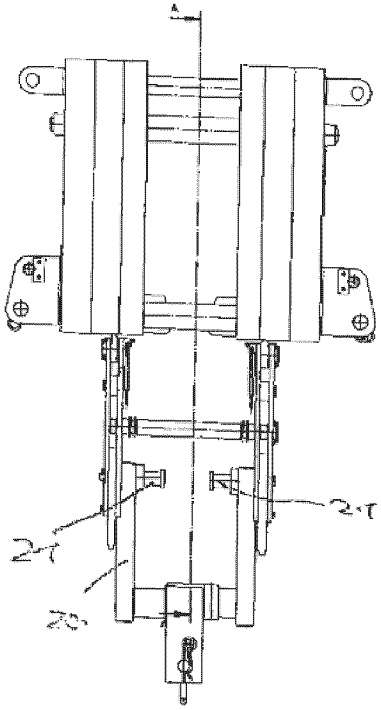
FIG. 5A: a rear view of a part of the coupling unit and of the carrier when the coupling unit and the carrier are coupled.

After a complete penetration of the cross-pin 21 into the coupling unit 11 in FIG. 5B due to the further lowering of the coupling unit 11 and/or due to the inherent weight of the counterweights 110, the hook 112 snaps back and the coupling unit 11 is again located in the latching position. In this respect, the cross-pin 21 is located in the reception groove 113 of the guide section 114. The snapping back of the hook is effected in that a force is exerted onto the transmission means 116 via the pivotal connection point 115 by the spring device 117. This force effects a rotational movement and thus a rotation of the transmission means 116 in the direction U. The rotation of the transmission means 116 is transmitted via the coupling means 118 to the hook 112, with the rotation being directed such that the hook 112 is pressed into the latching position.

Figure 6B:
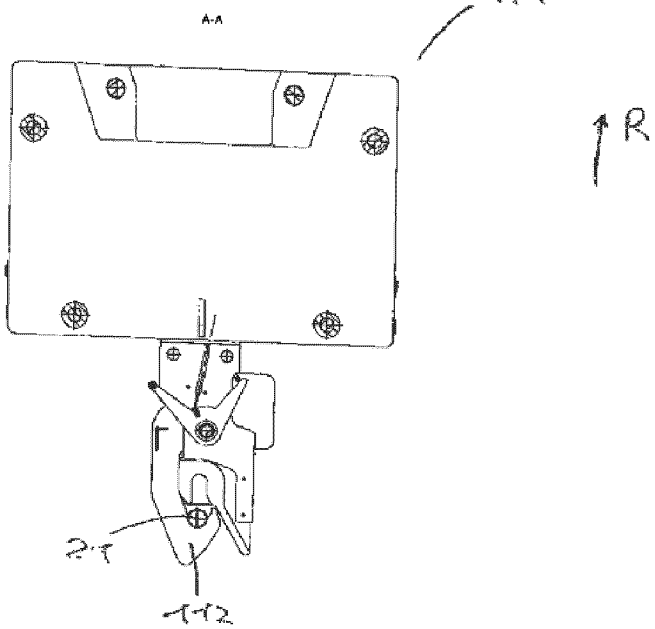
FIG. 6B: a sectional view along the line A-A of FIG. 6A.
Figure 6A:
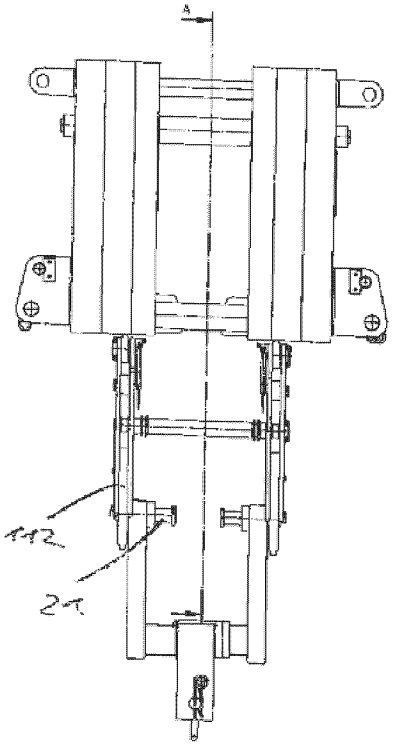
FIG. 6A: a rear view of a part of the coupling unit and of the carrier when the coupling unit is moved in a direction away from the ground.

On the movement of the coupling unit 11 shown in FIG. 6B and thus of the carrier 2 connected to the coupling unit 11 in a direction R away from the ground, the cross-pin 21 is located in a correspondingly formed reception region of the hook 112. In this respect, the reception region of the hook 112 is configured such that the weight of the carrier 2 and of the tower part carried thereby effect a torque about an axis of rotation 120 of the hook 112 which is directed such that the hook 112 is held in the latching position.

Figure 7B:
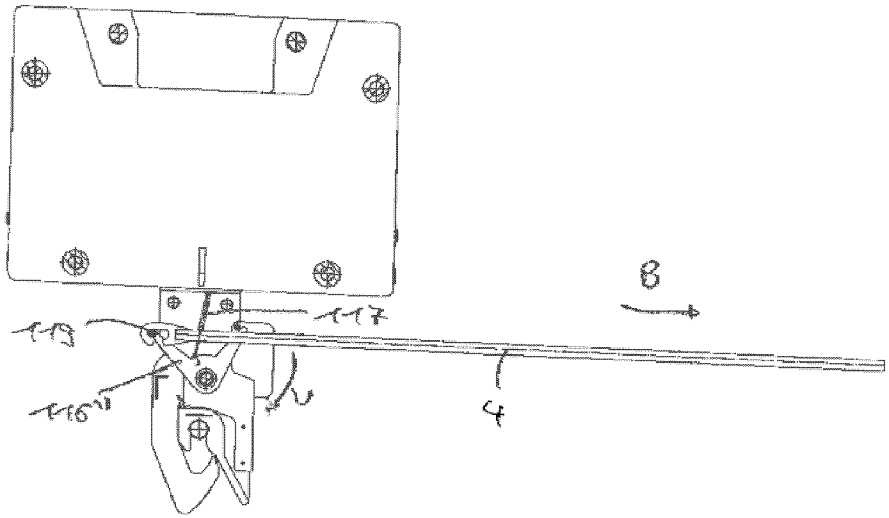
FIG. 7B: a sectional view along the line A-A of FIG. 7A.
Figure 7A:
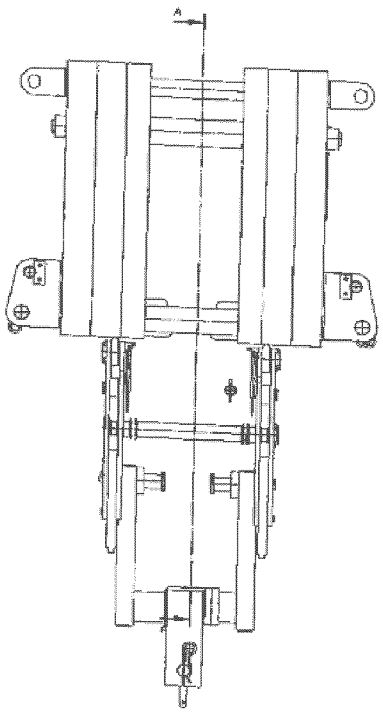
FIG. 7A: a rear view of a part of the coupling unit and of the carrier on the coupling of the coupling unit with an actuation bar.

In the position shown in FIGS. 7A and 7B, the coupling unit 11 and thus the tower part is located at the desired height above the ground. The carrier 2 is furthermore placed on the installation crane trolley 113 and is therefore located in the installation position. In this case, the hook 112 is no longer under load. In this position of the coupling unit 11, the cross-pin 21 is furthermore located in the reception groove 113 of the guide section.

Furthermore, an actuation bar 4 is shown in FIG. 7B which is coupled with a connection means 119 of a second limb 116" of the transmission means 116. The connection means 119 is arranged at the end of the second limb 116". The transmission means 116 is rotated in the direction U on a movement of the actuation bar in the direction B such that the connection means 119 of the second limb 116' moves in the direction toward the coupling means 118 of the hook 112.

Figure 8B:
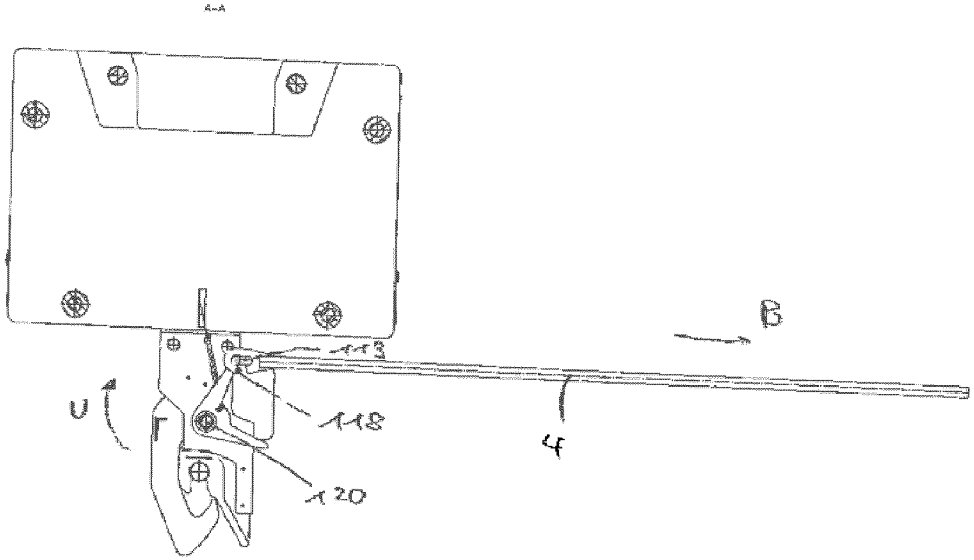
FIG. 8B: a sectional view along the line A-A of FIG. 8A.
Figure 8A:
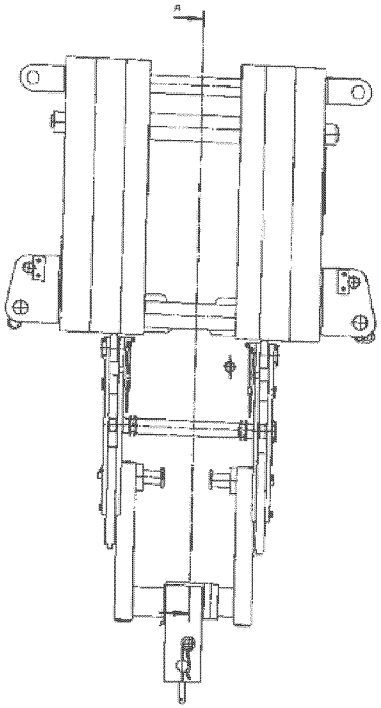
FIG. 8A: a rear view of a part of the coupling unit and of the carrier on a coupling of the coupling unit with the actuation bar, with the coupling unit being located in a latching position.
Figure 9B:
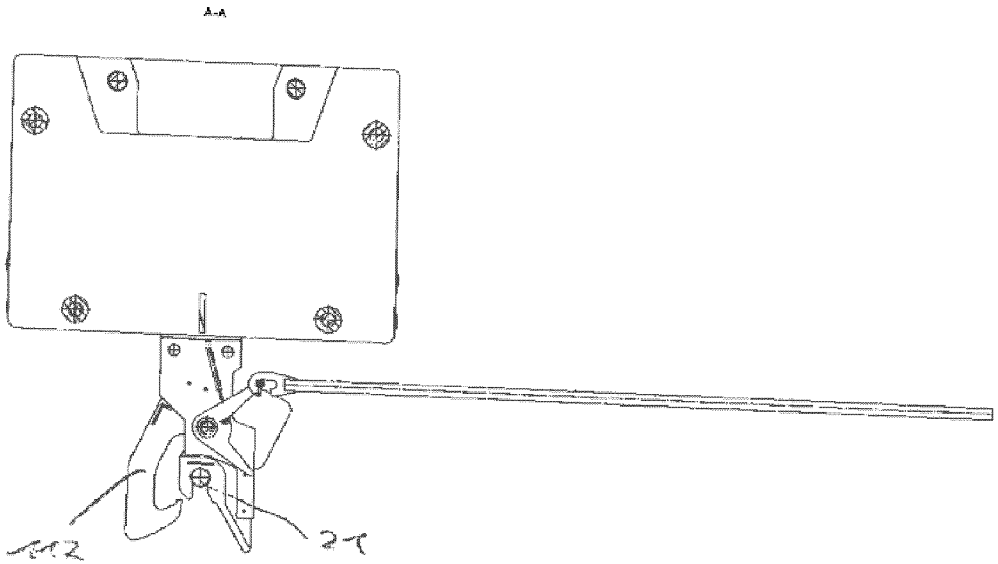
FIG. 9B: a sectional view along the line A-A of FIG. 9A.
Figure 9A:
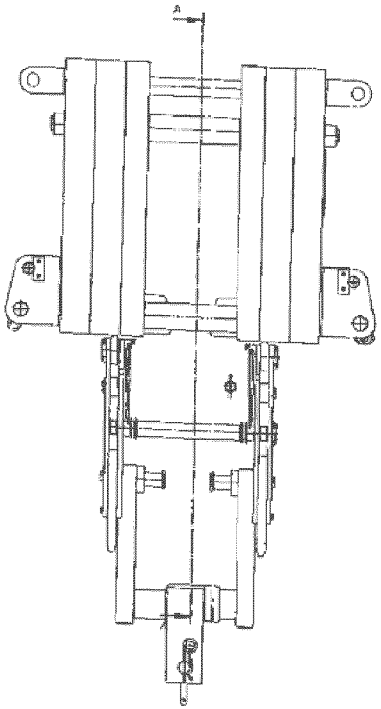
FIG. 9A: a rear view of a part of the coupling unit and of the carrier on a coupling of the coupling unit with the actuation bar, with the coupling unit being located in an unlatching position.

In FIGS. 9A and 9B, the state of the transmission means 116 is shown in which the end 119 of the second limb 116" is in contact with the coupling means 118. On a rotation of the transmission means 116 from the state shown in FIGS. 7A and 7B into the state shown in FIGS. 8A and 8B, the hook 112 does not rotate.

It only rotates when the transmission means 116 is rotated further in the direction U, starting from the position shown in FIGS. 8A and 8B or when the actuation bar is rotated further in the direction B. In the unlatching position of the coupling unit shown in FIGS. 9A and 9B, the carrier 2 can be released from the coupling unit 11 and can be traveled via the installation crane trolley, for example.

Figure 10B:
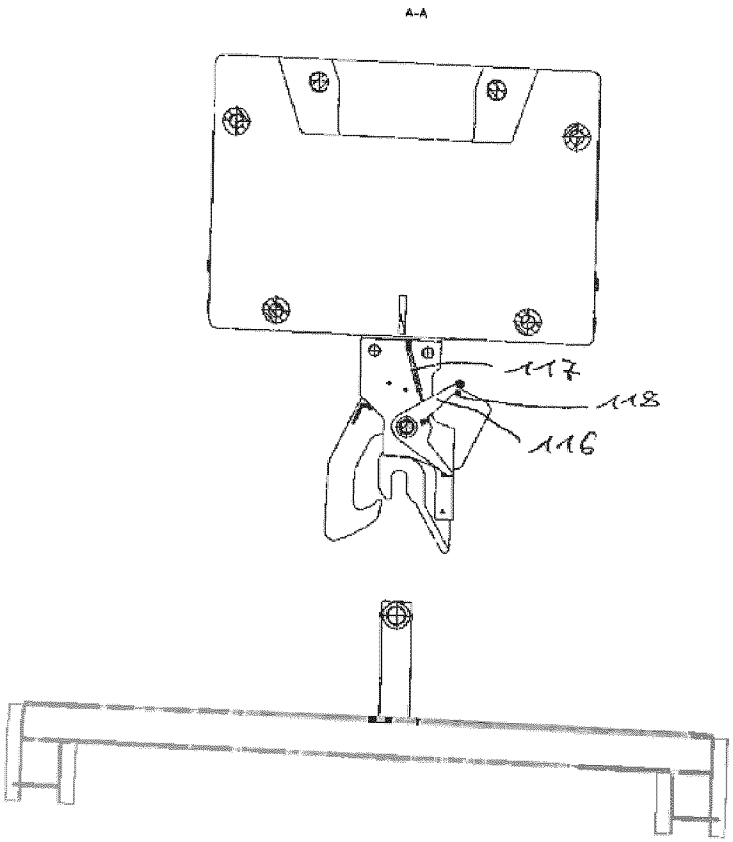
FIG. 10B: a sectional view along the line A-A of FIG. 10A.
Figure 10A:
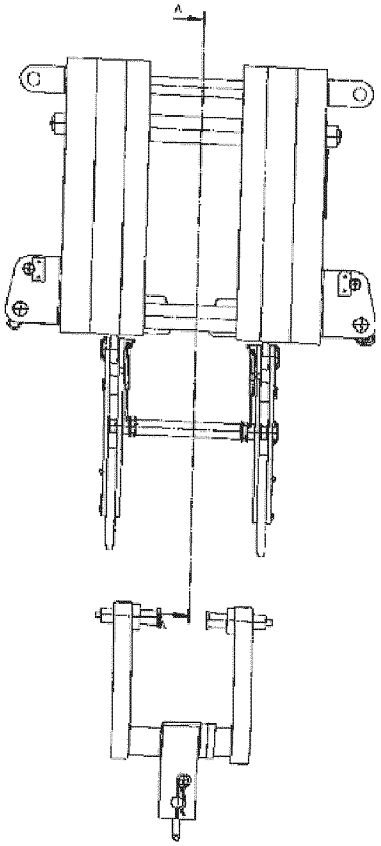
FIG. 10A: a rear view of a part of the coupling unit and of the carrier, with the coupling unit being located in an unlatching position.

In the position shown in FIGS. 10A and 10B, the transmission means 116 and thus the pivotal connection point 115 has been rotated so far that the force effected by the spring device 117 into the transmission means effects a torque and thus a rotation of the transmission means 116 in the direction U which rotates the hook 112 via the second limb 116" and the coupling means 118 into an unlatching position and holds it there. The hook 112 also remains in the unlatching position and does not automatically rotate back into the latching position.

Before a next carrier 2 is taken up by means of the coupling unit 11, the hook 112 has to be returned by the user into the position shown in FIG. 2 in which the spring device 117 holds the hook in the latching position. The return can take place via the actuation bar 4, for example, with the latter being actuated in a direction which is opposite to the direction B.

The invention claimed is:

1. An apparatus (1) for installing or dismantling a crane, and having a coupling unit (11) configured for coupling the apparatus (1) with a carrier (2) of a tower part (3) of the crane, wherein the coupling unit (11) is configured to be movable into a latching position for avoiding a release of the coupling between the coupling unit (11) and the carrier of the tower part (3) or into an unlatching position for coupling or decoupling the coupling unit (11) with the carrier of the tower part (3) of the crane, the coupling unit has a rotatable hook (112) which is coupled with a clamping unit, with the clamping unit holding the hook (112) in the latching position, the coupling unit (11) comprises, a counterweight (110), the hook (112) being pivotally mounted underneath the counterweight (110), a fastening section (111) pivotally coupling the hook (112) with the counterweight (110), a guide section (114) fixedly connected to the fastening section (111) and having a reception groove (113) at an end of a run-in slope thereof, the clamping unit having a spring device (117) interconnecting the coupling unit (11) and hook (112) to maintain the hook (112) in latching position, transmission means (116) rotatably mounted upon the fastening section (111) and coupled to the spring device (117) at a pivotal connection point (115) and having a first limb (116'), and the hook (112) having first coupling means (118) to which the first limb (116') of the transmission means (116) is coupled.

2. An apparatus in accordance with claim 1, wherein the transmission means (116) has a connection means (119) which are couplable to an actuation bar (4) to bring the coupling unit (11) into the unlatching position.

3. An apparatus in accordance with claim 1, wherein the counterweight (110) is movable into a balance position.

4. An apparatus (1) in accordance with claim 1, wherein the coupling unit (11) is configured to automatically latch the carrier (2) with the coupling unit (11), and avoid release of the coupling between the coupling unit (11) and the carrier (2) of the tower part (3), and be movable from the latching position into an unlatching position, and allowing the carrier (2) of the tower (3) to be decoupled from the coupling unit (11).

5. An apparatus (1) in accordance with claim 4, wherein the coupling unit (11) is configured to receive and latch cross-pins (21) of the carrier (2).

6. An apparatus (1) in accordance with claim 5, wherein the carrier (2) comprises a longitudinal frame (24) having first projections (26) extending from opposite ends thereof and each defining a reception space (23) for part of the tower (3), each said reception space (23) being bounded by a pin (22), and a second projection (20) extending from the longitudinal frame (24) in an opposite direction from the first projections (26), and with a latch cross-pin (21) provided on an end of the second projection (20) remote from the longitudinal frame (24).

7. An apparatus (1) in accordance with claim 1, wherein the transmission means (116) comprises a second limb (116") and connection means (119) arranged at the end of the second limb (116").

8. An apparatus (1) in accordance with claim 1, wherein the counterweight (110) is positioned on top of the coupling unit (11).

* * * * *